United States Patent [19]

Shyang

[11] Patent Number: 4,694,614

[45] Date of Patent: Sep. 22, 1987

[54] MULTIPURPOSE POLISHER

[76] Inventor: Yang C. Shyang, P.O. Box Taichung 2103, Taichung, Taiwan

[21] Appl. No.: 898,580

[22] Filed: Aug. 21, 1986

[51] Int. Cl.[4] ..... B24B 21/00

[52] U.S. Cl. ..... 51/141

[58] Field of Search ..... 51/135 R, 141

[56] References Cited

U.S. PATENT DOCUMENTS

| | | | |
|---|---|---|---|
| 294,766 | 3/1884 | Coy | 51/141 |
| 812,317 | 2/1906 | Wysong | 51/141 |
| 832,114 | 10/1906 | Wysong | 51/141 |
| 2,725,691 | 12/1955 | Sommer et al. | 51/141 |
| 4,091,574 | 5/1978 | Horwitz | 51/141 |
| 4,204,371 | 5/1980 | Horwitz | 51/141 |

*Primary Examiner*—Robert P. Olszewski

*Attorney, Agent, or Firm*—Bacon & Thomas

[57] ABSTRACT

A multi-purpose polisher comprising a base, a column, an abrasive belt, a pulley support, an upper pully, a work stand, a support plate, a radial frame, a plurality of support arms and a plurality of supporting wheels. The radial frame with support arms and supporting wheels is connected to the swivelling shaft fixed to the support plate on the column in such way that the radial frame can be turned and swung to allow the desired support wheel to place behind the abrasive belt so as to meet the requirement of polishing workpieces of different shape.

3 Claims, 4 Drawing Figures

MULTIPURPOSE POLISHER

BACKGROUND OF THE INVENTION (a) Field of the invention

This invention relates to a multi-purpose polisher which is easy to operate and to change to a desired supporting wheel so as to meet the requirement of polishing workpieces of different shape.

(b) Description of Prior Art

Conventional polishers do polishing with running abrasive belts. But these polishers are of single purpose. In other words, they are designed to polish metal of one shape. A polisher for polishing a flat surface can not be used for irregular surfaces. Although a few polishers are available for polishing metal of different shape, they are complicated in structure and difficult to change the elements.

SUMMARY OF THE INVENTION

A multi-purpose polisher can polish workpieces of different shape with an endless abrasive belt and exchangeable supporting wheels. The radial frame with support arms and supporting wheels is fixed to a swivelling shaft and can be turned and swung freely to put the arm in the fixing recess of the column and attracted by the magnet on the support plate, and to place the desired supporting wheel directly behind the abrasive belt to meet the need of polishing workpieces of different shape.

DESCRIPTION OF THE PREFERRED EMBODIMENT

Figure 1:
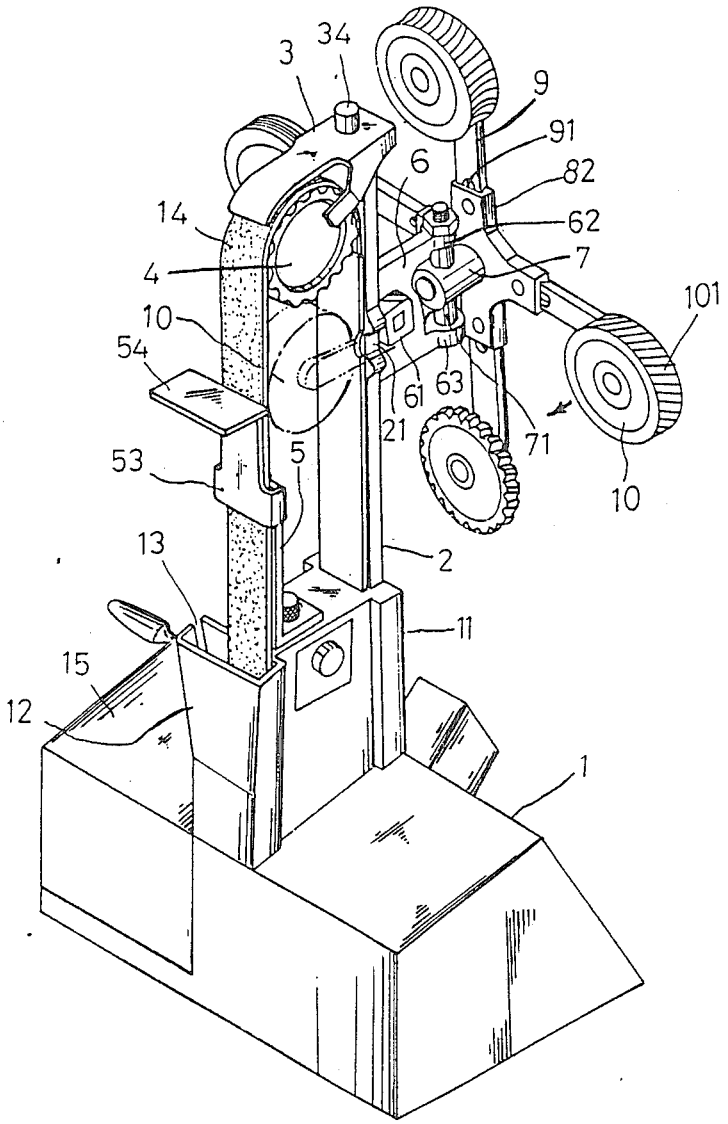
FIG. 1 is a vertical view of the multi-purpose polisher of this invention.

As shown in FIG. 1, the multi-purpose polisher of this invention comprises a base 1, a column 2, a pulley support 3, an upper pulley 4, a work stand 5, a support plate 6, a swivelling shaft 7 a radial frame 8, a plurality of support arms 9 and a plurality of supporting wheels 10. The motor and drive in the polisher base 1 are same as conventional ones without need of further description. The base 1 with a stand 11 has a column 2 at the rear and a guard 12 in the front. The guard 12 has an indenture 13. The abrasive belt 14 can be removed from the polisher base 1 after the openable cover 15 of the base 1 is open.

Figure 4:
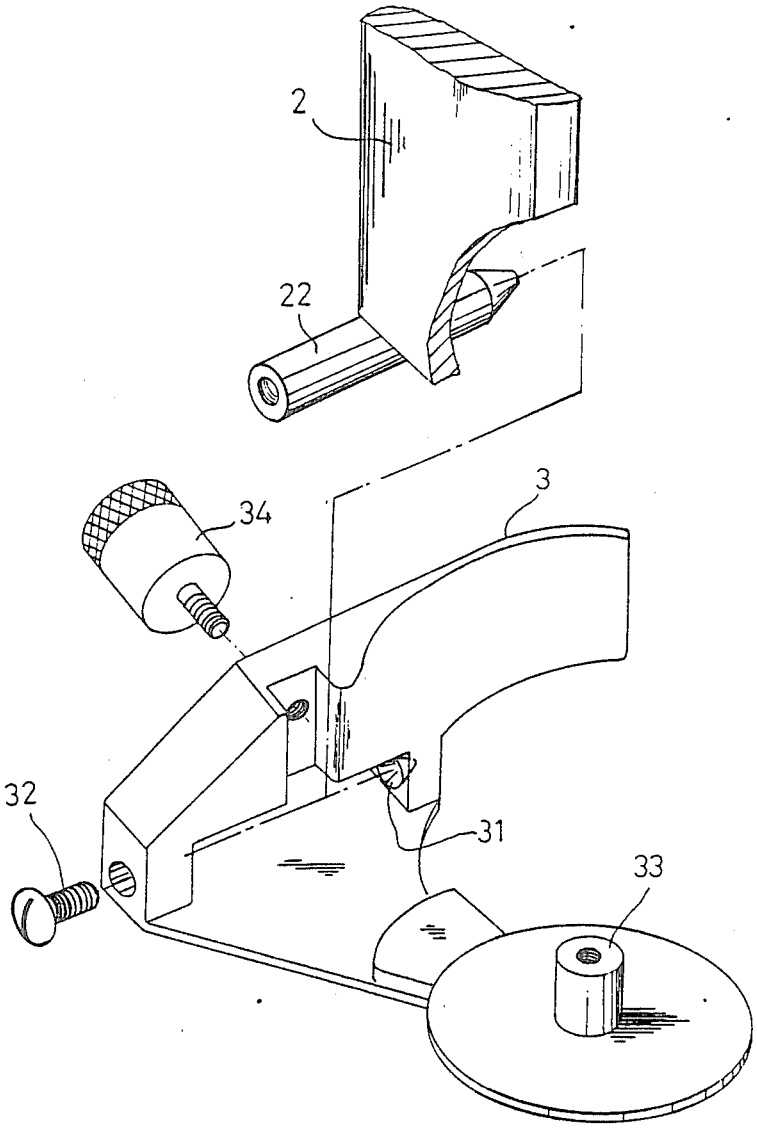
FIG. 4 is an exploded view of the pulley support of the said polisher.

The column 2 is vertically mounted on the base 1 and has a fixing recess 21 for the support arm 9 to rest. The column 2 has a fixing pin 22 as shown in FIG. 4 to fix the pulley support 3. The tip of the fixing pin 22 is inserted in the pin hole 31 of the pulley support 3. A screw 32 is inserted in the hole opposite the pin hole 31 and screwed in the screw hole in the flat end of the fixing pin 22. The pulley support 3 has an axle 33, on which the upper pulley 4 turns, and an adjusting screw 34, of which the end bears against the top of the column 2 to adjust the position of the upper pulley 4 and the perpendicularity of the pulley support 3. It must be noted that the adjusting screw 34 must be situated in one side of the pulley supports to exert its function. The upper pulley 4 is mounted on the axle 33 with a bearing for free revolving. The rim of the upper pulley 4 is covered with foamed PU so that the abrasive belt 14 on it will not slip off. The abrasive belt 14 is an endless strap running on the rims of the upper pulley 4 and the driving wheel in the base 1.

The polishing table has an L stand 5 with an slot 51 in the horizontal piece for fixing to the stand 11 of the base 1 with a screw and another slot hole 52 in the vertical piece for fixing to the work table 53. The height of the work table 53 is adjustable. For flat polishing the work table 53 is lowered so that the table top 54 is lower than the top edge of the stand 5. The work stand 5 is situated at the back of the abrasive belt and the work table 53, is front of it. The work table 53 is fixed to the stand 5 in such way that the abrasive belt 14 can be removed easily through one side.

Figure 2:
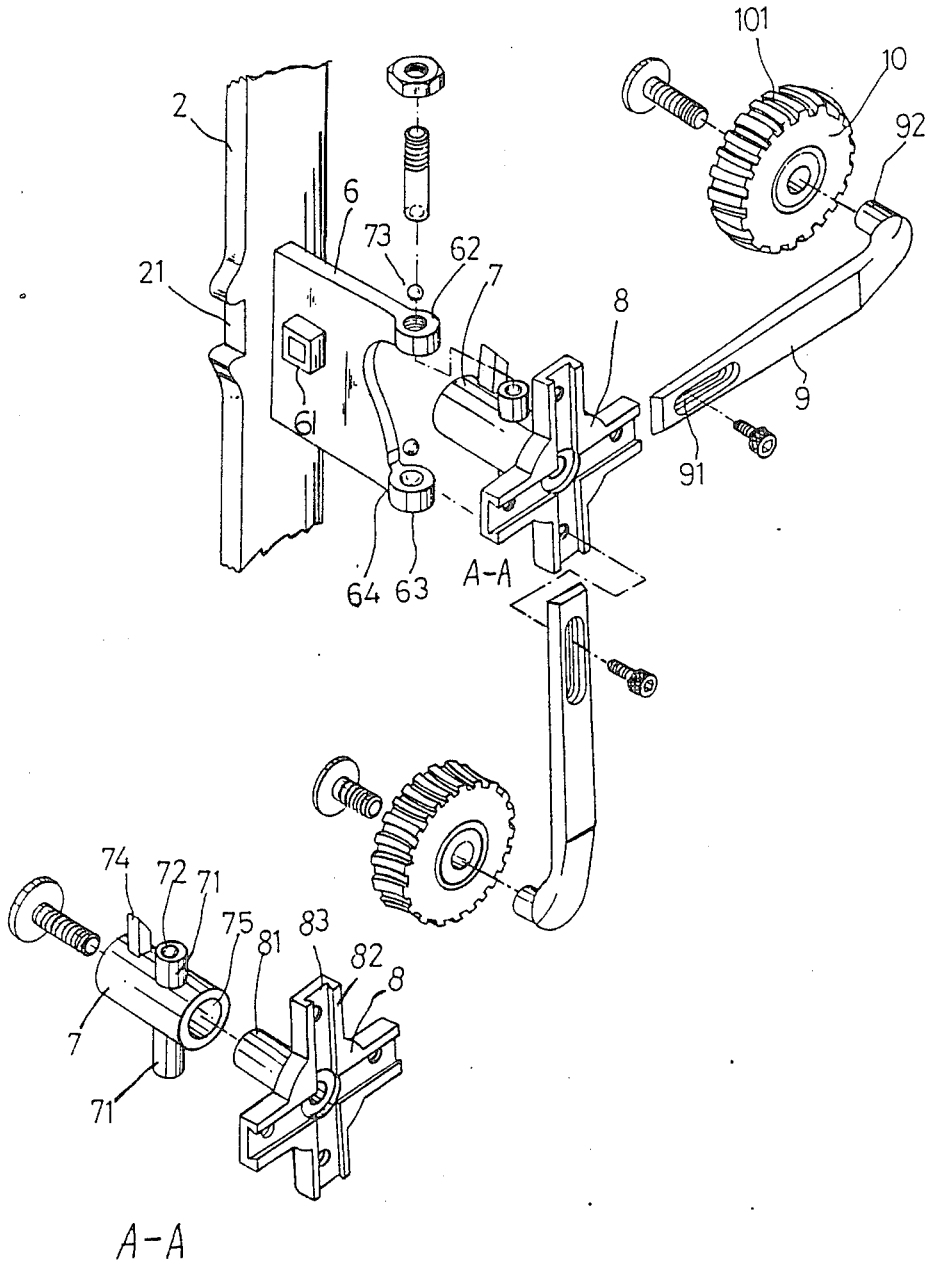
FIG. 2 is a partially exploded view of the said polisher.
Figure 3:
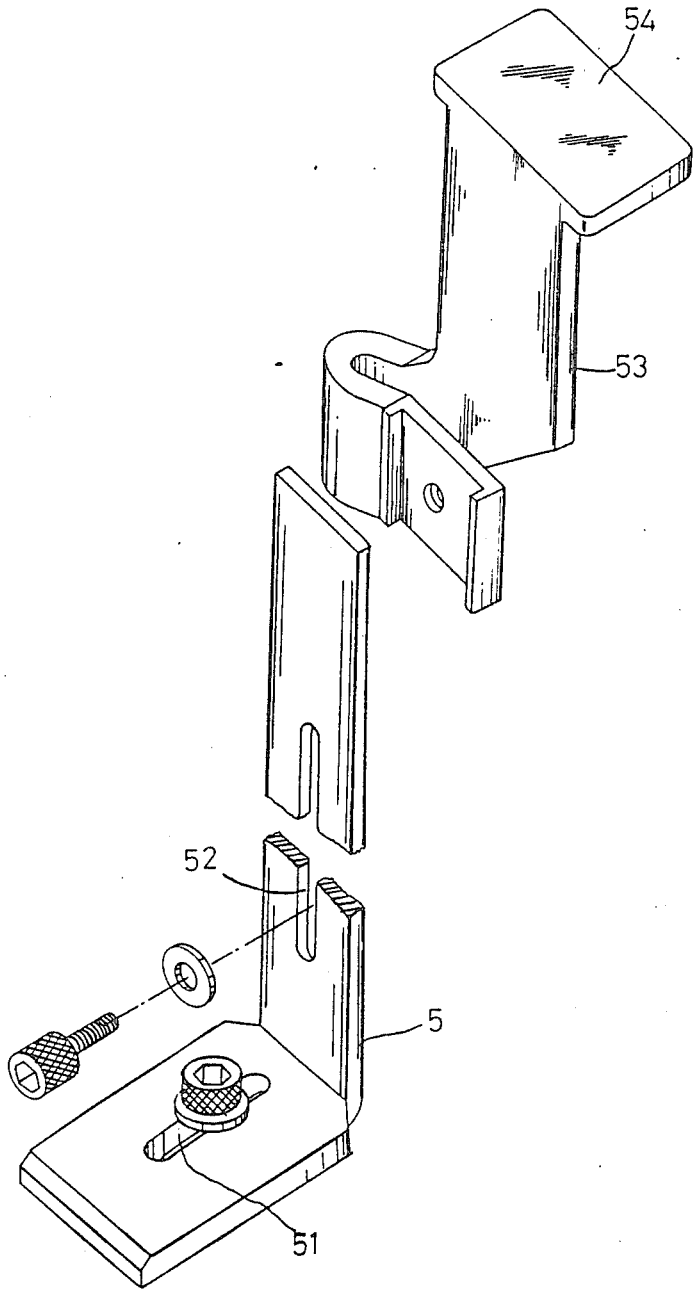
FIG. 3 is an exploded view of the polishing table of the said polisher.

As shown in FIG. 2, the support plate 6 is fixed to the back of the column 2 and has a magnet 61 in the place as high as the fixing recess 21 of the column 2, the support plate 6 also has an upper knuckle 62 and lower knuckle 63 at rear end. The upper knuckle 62 has a screw hole and the lower knuckle 63 has a ball socket half 64. The pivot pin 71 has a ball socket half at each end. The bolt screwed in the screw hole of the upper knuckle 62 also has a ball socket half. These ball socket halves and two balls 73 form an upper ball and socket joint and a lower ball and socket joint. With these joints the shaft 7 is swingably connected with the support plate 6. The swivelling shaft 7 has a stop block 74 which will bear against the support plate 6 when the shaft swings counter clockwise and prevent the shaft 7 from further swinging. The shaft 7 has a longitudinal hole 75 for the stub 81 of the radial frame 8 to turnably fit in.

The stub 81 of the radial frame 8 is fitted in the shafts and turnably fixed therein with a screw from the front end of the shaft 7. The radial frame 8 has a plurality of arm supports 82. Each arm support has an inserting groove 83 of equal width for the supporting arm 9 to fix. The supporting arm 9 has an slot 91 near the rear end for fixing itself to the arm support 82 with a screw and for adjusting the protrusion length of the supporting arm 9. The supporting arm 9 has an axle 92 for the supporting wheel 10 to fit on. The axle 92 is perpendicular to the arm axis as well as to the abrasive belt 14. The supporting wheel 10 has a bearing for smooth running and has a rim 101 made of foamed PU and in different shape or width to meet the requirement. To prevent the supporting wheel from falling off, a screw is screwed in the front end of the axle 92.

As shown in FIG. 1, when not in use, the supporting wheels 10 are kept off the abrasive belt 14 and are in still state because the stop block 74 of the swivelling shaft 7 bears against the support plate 6. As shown in FIG. 2, the swivelling shaft 7 mounted on the support plate 6 can swivel radially and the radial frame 8 fitted to the rear end of the swivelling shaft 7 can turn freely. So prior to use, the radial frame 8 can be turned to get the desired supporting wheel 10 in the place opposite the fixing recess 21 of the column 2 and then the radial frame 8 is swung until the supporting arm 9 of the desired supporting wheel 10 rests in the fixing recess 21 of the column 2. At this time, the supporting arm 9 made of iron is attracted by the magnet 61 of the support plate 6 and fixed in place with the desired wheel 10 bearing against the back side of the abrasive belt 14. With the abrasive belt running after the motor is started, the work piece can be put on the top 54 of the work table 53 for polishing. To change the supporting wheel 10, the supporting arm 9 is pulled off the fixing recess 21 and the magnetic field of the magnet 61, and the above mentioned procedures are repeated for another desired supporting wheel 10. Flat polishing can be done either by using a supporting wheel 10 with flat rim 101 or by lowering the work table 53 in such way that the top 54 is lower than the top edge of the work stand 5 which is then used as the supporting wheel 10.

I claim:

1. A multi-purpose polisher comprising:

a base having a stand and an openable cover, a column vertically mounted on the base and having a fixing recess in an appropriate place and a fixing pin at the top end, a pulley support fixed to the column with said fixing pin and having a wheel axle, an upper pulley fitted on the said wheel axle, an abrasive belt fitted in the column and on the upper pulley, a work stand being in L shape and having a long slot in the vertical piece and a short slot in the horizontal piece, a work table fixed to the said work stand and being adjustable in height with the slot, a support plate fixed to the back of the column and having a magnet in the plate as high as the work stand, and an upper knuckle and a lower knuckle, a swivelling shaft having a vertical pivot pin for connecting with the upper and lower knuckles of the support plate by means of ball and socket joints, and a stop block for making the shaft stop in an appropriate place, a radial frame having a stub fitted in the swivelling shaft, and a plurality of arm supports extending radially from the hub, a plurality of support arms having slots at one end for fixing with the arm supports, and axles perpendicular to an arm axis, mounting a plurality of supporting wheels having rims in different shapes or widths;

said swivelling shaft being so arranged that any one of the supporting wheels can be selectively placed behind the abrasive belt and changed to another one of said supporting wheels to meet various requirements of polishing.

2. A multi-purpose polisher according to claim 1 wherein the work stand is mounted behind the abrasive belt and the work table in the front of the abrasive belt.

3. A multi-purpose polisher according to claim 1 wherein the support arm is fixed in the fixing recess in the column by attraction of the magnet.

* * * * *